US005335518A

United States Patent [19]

Lonati et al.

[11] Patent Number: 5,335,518

[45] Date of Patent: Aug. 9, 1994

[54] CIRCULAR KNITTING MACHINE FOR MANUFACTURING SOCKS, STOCKINGS AND THE LIKE, WITH DEVICE FOR PRODUCING PATTERNS WITH TOWELING STITCHES

[75] Inventors: Francesco Lonati; Ettore Lonati; Fausto Lonati; Tiberio Lonati, all of Brescia, Italy

[73] Assignee: Santoni S.r.l., Brescia, Italy

[21] Appl. No.: 989,662

[22] Filed: Dec. 14, 1992

[30] Foreign Application Priority Data

Dec. 19, 1991 [IT] Italy ..... MI91 A 003411

[51] Int. Cl.[5] ..... D04B 9/12; D04B 9/46

[52] U.S. Cl. ..... 66/108 R; 66/217; 66/93

[58] Field of Search ..... 66/93, 107, 108 R, 216, 66/217

[56] References Cited

U.S. PATENT DOCUMENTS

| | | | |
|---|---|---|---|
| 1,699,321 | 1/1929 | Wildt et al. | 66/108 R X |
| 2,098,446 | 11/1937 | Agulnek | 66/93 |
| 2,101,005 | 11/1937 | Lawson | 66/108 R X |
| 2,134,480 | 10/1938 | Houseman | 66/108 R X |
| 2,703,970 | 3/1955 | Reymes-Cole et al. | 66/108 R X |
| 3,877,258 | 4/1975 | Uhlir | 66/93 |
| 4,519,221 | 5/1985 | Hirano | 66/107 |

FOREIGN PATENT DOCUMENTS

| | | |
|---|---|---|
| 0335618 | 10/1989 | European Pat. Off. . |
| 2642079 | 3/1978 | Fed. Rep. of Germany . |

*Primary Examiner*—Clifford D. Crowder
*Assistant Examiner*—John J. Calvert
*Attorney, Agent, or Firm*—Guido Modiano; Albert Josif; Daniel O'Byrne

[57] ABSTRACT

The machine is provided with casting-off sinkers having two casting-off surfaces which are mutually spaced in a direction which is parallel to the axis of the needle cylinder to form toweling stitches. The machine has auxiliary jacks which are accommodated in axial grooves of a needle cylinder and can move, when actuated, along these grooves parallel to the axis of the needle cylinder so as to act, with their upper end, on the casting-off sinkers to move them in a direction which is radial to the needle cylinder from a rearward position, in which they receive two threads engaged by the contiguous needles on a same one of the two casting-off surfaces, forming two loops of knitting of equal length, to an advanced position in the direction of the axis of the needle cylinder, in which they receive the two threads engaged by the contiguous needles respectively on one of the casting-off surfaces and on the other casting-off surface so as to form two loops having mutually different lengths, i.e. toweling stitches.

1 Claim, 3 Drawing Sheets

7
7
6
20
30a
29
33
32
32a
19
31
31a
19a
30
5
10
10a
9a
28
8a
5a
11
9
8
26
24b
23
27
24
27
24b
25
25b
25a
24a

CIRCULAR KNITTING MACHINE FOR MANUFACTURING SOCKS, STOCKINGS AND THE LIKE, WITH DEVICE FOR PRODUCING PATTERNS WITH TOWELING STITCHES

BACKGROUND OF THE INVENTION

The present invention relates to a circular knitting machine for manufacturing socks, stockings and the like, with device for producing patterns with toweling stitches.

As is known, circular knitting machines for manufacturing socks and stockings or the like comprise a needle cylinder which is arranged vertically and on whose skirt a plurality of axial grooves is defined; each groove accommodates a needle in such a manner that it can slide parallel to the axis of the needle cylinder, and each needle is provided with a heel which protrudes radially from the related axial groove.

Needle actuation cams are arranged around the skirt of the needle cylinder and define paths which can be engaged by the heel of the needles when the needle cylinder is rotatably actuated about its axis with respect to the needle actuation cams. The paths defined by the actuation cams are shaped so as to cause, during the rotation of the needle cylinder about its own axis, a movement of the needles along the related axial grooves of the needle cylinder which causes the tip of the needles to protrude upward from the upper end of the needle cylinder so as to engage the thread or threads fed at a feed, or drop, of the machine and so as to subsequently retract into the needle cylinder, forming new loops of knitting linked to the previously formed loops which are cast off the needles and descend into the needle cylinder. The needle actuation cams also define paths which avoid this movement of the needles, keeping them inside the grooves of the needle cylinder so as to prevent them from taking up the thread provided at a feed, excluding them from the knitting in progress.

The actuation or exclusion of the needles at a feed of the thread or threads is obtained by means of selection devices which move the needles along the related axial grooves of the needle cylinder, so as to shift the heel of the needles from one path to another path, both of which are defined by the needle actuation cams.

Some of the selection devices currently in use comprise a selector arranged in each axial groove of the needle cylinder below the needle and provided with a heel which extends radially with respect to the needle cylinder. Each selector can oscillate in a plane which is radial with respect to the needle cylinder to pass from an inactive position, whereat it is sunk so that its heel is inside the related groove of the needle cylinder, to an active position, whereat said heel protrudes radially from the related axial groove to engage selector actuation cams which, similarly to the needle actuation cams, are arranged around the needle cylinder and have ascending portions and descending portions to move the selectors along the related axial grooves in a direction which is parallel to the axis of the needle cylinder during the rotation of the needle cylinder with respect to the actuation cams.

The selectors are shifted from the inactive position to the active position, or vice versa, by means of various types of devices which laterally face the needle cylinder and interfere, or do not interfere, depending on the actuation imparted to them, with lugs of the selectors which have been moved beforehand into the active position to return the selectors to the inactive position or to keep them in said active position and thus produce their engagement with the selector actuation cams.

Proximate to the upper end of the needle cylinder there is also a sinker ring in which a plurality of radial grooves is defined; said grooves are angularly offset with respect to the axial grooves of the needle cylinder, and each one slidably accommodates a casting-off sinker along a direction which is radial with respect to the needle cylinder. The casting-off sinkers are provided with a heel which protrudes upwardly from the radial grooves of the sinker ring and engages within a path, defined by sinker actuation cams, which causes a cyclic movement of the sinkers toward or away from the axis of the needle cylinder. With this movement, the sinkers are moved so that one of their longitudinal ends, which is flat, is arranged between two contiguous needles so that the thread, or threads, engaged by the needles rests on this portion while the needles retract into the grooves of the needle cylinder, forming new loops of knitting.

Special sinkers are used to form toweling or loop pile stitches; they have two flat portions which are mutually spaced in a direction which is parallel to the axis of the needle cylinder, are termed casting-off surfaces and are mutually separated by a tab. Said sinkers are moved in the direction of the needle cylinder axis when the contiguous needles have started their downward movement after engaging at least two threads at a feed so that the tab of the sinker is inserted between these two threads, making one thread rest on a casting-off surface and the other thread rest on the other casting-off surface, with the consequent forming of toweling stitches.

With current knitting machines it is possible to produce knitting formed completely with toweling stitches or knitting with portions with toweling stitches alternated with portions knitted with normal stitches. In this latter case, long-heeled sinkers and short-heeled sinkers are arranged in the sinker ring, for actuating the two types of sinkers in different manners so as to alternate plain knitting with toweling-stitch knitting.

In any case, with current machines it is not possible to individually actuate the casting-off sinkers so that they form toweling stitches while performing one row of knitting and form normal stitches while performing a subsequent row, so as to obtain patterns with toweling stitches alternated with normal stitches and even with a complicated outline.

On the other hand, it is not possible to individually select the sinkers by means of a selection device which faces the sinker ring in an upward position due to the bulk problems which are particularly felt in this region of the machine.

SUMMARY OF THE INVENTION

The aim of the present invention is to solve the above described problem by providing a circular knitting machine for manufacturing socks, stockings and the like, with a device which allows to produce patterns by alternating knitting with normal stitches with toweling stitches.

Within the scope of this aim, an object of the invention is to provide a machine in which it is possible to select the sinkers individually.

Another object of the invention is to provide a machine capable of producing products with patterns with toweling stitches which can be obtained with simple modifications from a known circular knitting machine for manufacturing socks or stockings.

A further object of the invention is to provide a machine which offers adequate assurances of safety and reliability during operation.

This aim, these objects and others which will become apparent hereinafter are achieved by a circular knitting machine for manufacturing socks, stockings or the like, with a device for producing patterns with toweling stitches, comprising a needle cylinder having a skirt on which a plurality of axial grooves is defined, each of said grooves slidably accommodating a needle slideable along directions parallel to the axis of the needle cylinder, and having a heel which protrudes radially from the related axial groove and can engage within paths defined by needle actuation cams arranged around the needle cylinder upon a rotation of the needle cylinder about its own axis with respect to said needle actuation cams, a sinker ring being arranged proximate to the upper end of the needle cylinder, said sinker ring being rigidly associated with the needle cylinder, a plurality of radial grooves being defined in said sinker ring, said radial grooves being angularly offset with respect to said axial grooves, each radial groove slideably accommodating a casting-off sinker defining two casting-off surfaces which are mutually spaced in a direction which is parallel to the axis of the needle cylinder, characterized in that it comprises auxiliary jacks individually accommodated in said axial grooves proximate to said needles and being movable, when actuated, parallel to the axis of the needle cylinder to act, with their upper end, on said casting-off sinkers to move them along a direction which is radial with respect to the needle cylinder from a rearward position, which produces the resting of two threads engaged by the contiguous needles on a same surface of said two casting-off surfaces to form loops with two threads of equal length, to an advanced position in the direction of the axis of the needle cylinder, which causes the resting of two threads engaged by the contiguous needles respectively on one of said two casting-off surfaces and on the other one of said two casting-off surfaces to form loops with two threads of mutually different lengths.

BRIEF DESCRIPTION OF THE DRAWINGS

Further characteristics and advantages of the present invention will become apparent from the description of a preferred but not exclusive embodiment of the machine according to the invention, illustrated only by way of nonlimitative example in the accompanying drawings, wherein.

DESCRIPTION OF THE PREFERRED EMBODIMENTS

Figure 1:
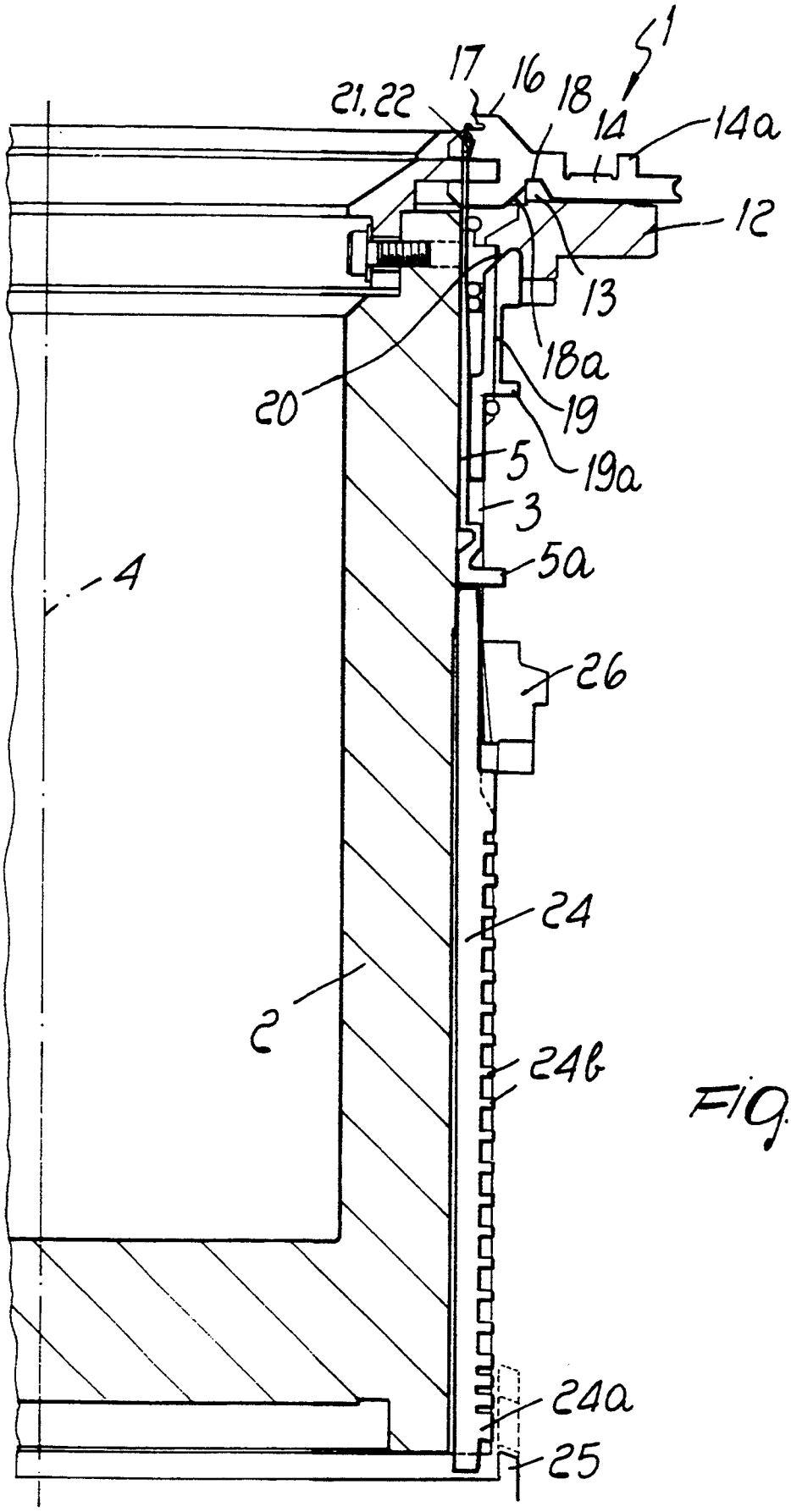
FIG. 1 is a schematic axial sectional view of a portion of the machine according to the invention, illustrating a casting-off sinker in the position which corresponds to the forming of normal stitches.
Figure 2:
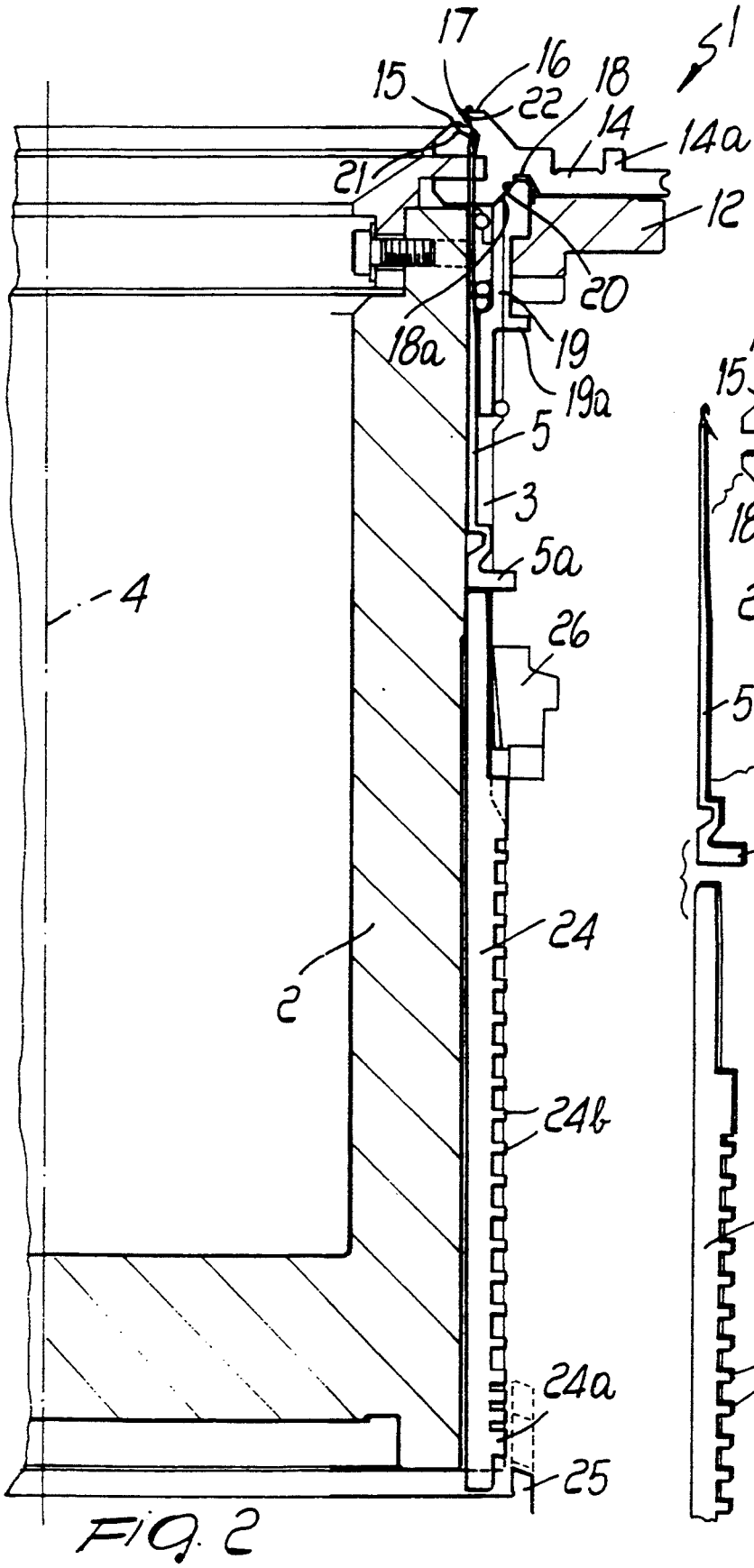
FIG. 2 is a sectional view, taken similarly to FIG. 1, illustrating a casting-off sinker in the position which corresponds to the forming of toweling stitches.
Figure 3:
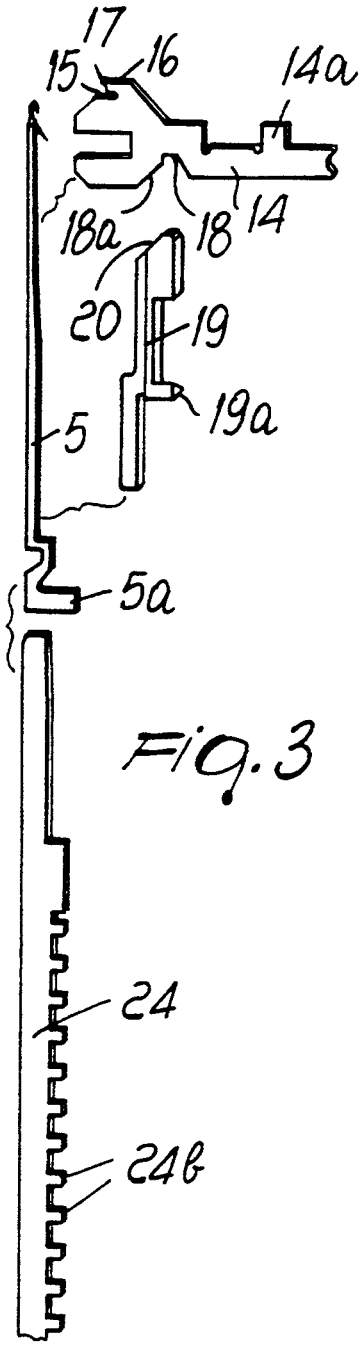
FIG. 3 is a perspective view of the set of elements intended to be accommodated in a same axial groove of the needle cylinder and in a radial groove of the sinker ring.

With reference to the above figures, the machine according to the invention, generally designated by the reference numeral 1, comprises a needle cylinder 2 which is arranged vertically and has a skirt on which a plurality of axial grooves 3 is defined; each one of said grooves slidably accommodates a needle 5 for sliding movement in a direction which is parallel to the axis 4 of the needle cylinder.

Needle actuation cams are arranged around the needle cylinder 2 and define paths which can be engaged by a heel 5*a* of the needles which protrudes radially from the needle cylinder. The paths defined by the needle actuation cams have ascending portions and descending portions so as to obtain, by means of the rotation of the needle cylinder 2 about its own axis 4 with respect to said cams, a reciprocating motion of the needles 5 along the related axial grooves 3 to form loops of knitting.

Figure 4:
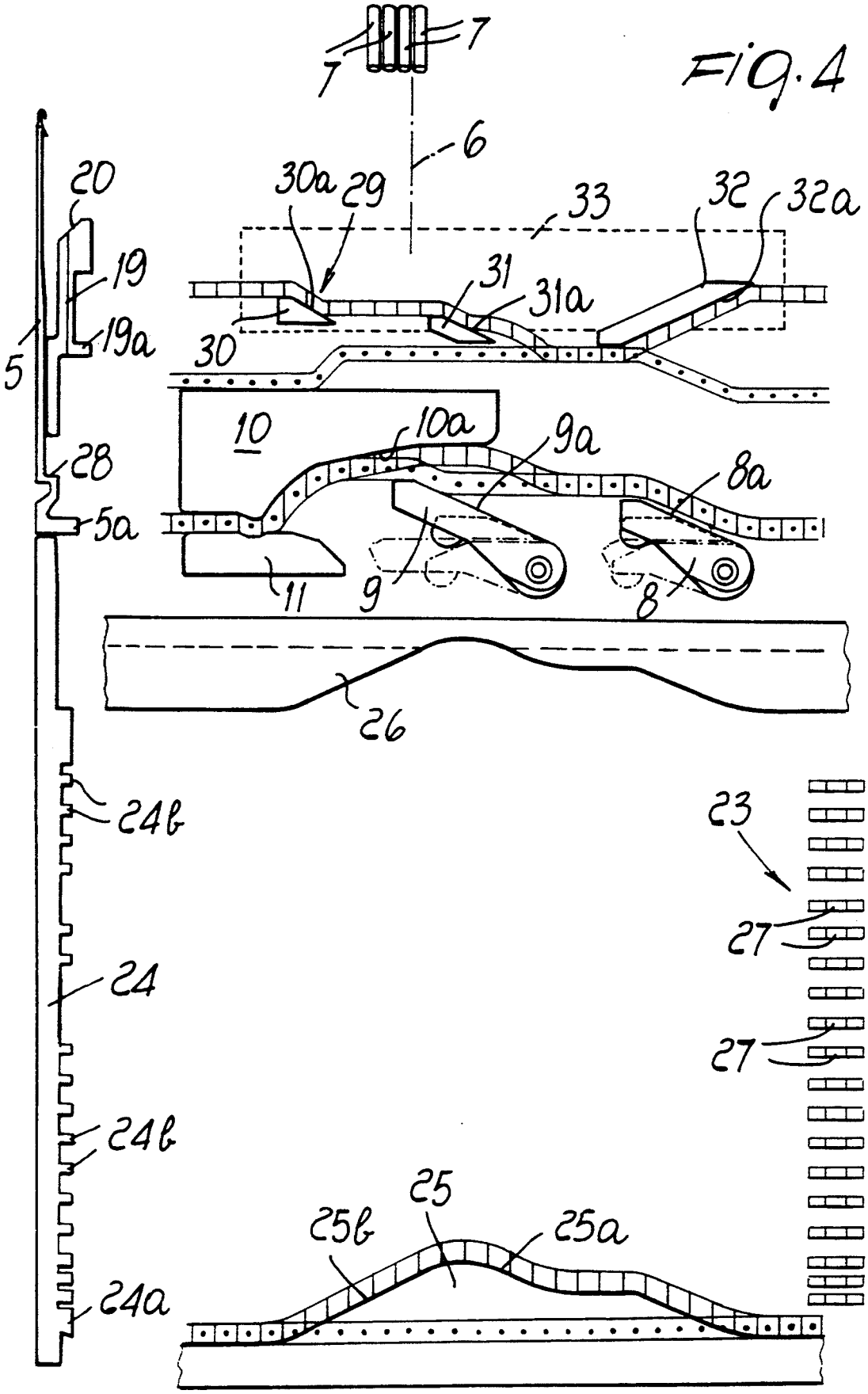
FIG. 4 is a schematic developed view illustrating the shape of the cam skirt of the machine in a plane, and showing a portion of the skirt proximate to a feed or drop of the machine, with the cam-actuated elements arranged adjacent.

With particular reference to FIG. 4, the needle actuation cams comprise, proximate to a feed or a drop of the machine, defined by the line 6, where thread guides 7 which supply the thread to the needles are arranged, two movable cams, respectively 8 and 9, with ascending portions 8*a* and 9*a* arranged upstream of the feed 6 along the direction of rotation of the needle cylinder 2 and a casting-off cam 10 with a descending portion 10*a* which is arranged at and downstream of the feed 6 and faces a counter-cam 11.

Proximate to the upper end of the needle cylinder 2 there is a sinker ring 12 which is coaxial to the needle cylinder and is rigidly coupled thereto in rotation about its axis 4 with respect to the needle actuation cams.

The sinker ring 12 is provided with a plurality of radial grooves 13, each of which accommodates a casting-off sinker 14. The radial grooves 13 are angularly offset with respect to the axial grooves 3, so that a radial groove 13 is flanked by two contiguous axial grooves 3.

The casting-off sinkers are of the type suitable for forming toweling stitches, i.e. they have a body which is shaped like an elongated lamina and is provided, in an intermediate region of its extension, with a heel 14*a* which extends transversely and protrudes upwardly from the radial grooves 13 to engage cams, of a known type not illustrated for the sake of simplicity, which are rigidly coupled to the needle actuation cams and cause, during the rotation of the needle cylinder and of the sinker ring 12 about the axis 4, a movement of the casting-off sinkers 14 along the radial grooves 13 toward or away from the axis 4.

The end of the sinkers 14 which is directed toward the axis 4 is shaped so as to define two casting-off surfaces 15 and 16 which are mutually spaced in a direction which is parallel to the axis 4 and are separated by a tab 17.

A recess 18 is defined on the back of the sinkers 14 and has a portion 18*a* which defines a plane which is inclined with respect to the longitudinal axis of the sinkers.

The machine according to the invention is conveniently provided with auxiliary jacks 19, each one arranged in an axial groove 3 at the level of the needles 5.

The auxiliary jacks 19 can move, when actuated, along the related axial groove 3 in a direction which is parallel to the axis 4 in order to act, with their upper end, which is shaped like an inclined plane 20 and is conveniently thicker, on the inclined-plane portion 18*a* of the overlying sinkers 14 to move them along a direction which is radial with respect to the needle cylinder from a rearward position, which causes the resting of two threads 21 and 22 engaged by the same needle 5 on the lower casting-off surface 15 to obtain loops of knitting with two threads of equal length, to an advanced position in the direction of the axis 4, which causes the resting of the two threads 21 and 22 respectively on the lower casting-off surface 15 and on the upper casting-off surface 16 to obtain loops of knitting with two threads of mutually different lengths, i.e. toweling stitches.

Advantageously, the actuation of the auxiliary jacks 19 to form toweling stitches is obtained by means of a needle selection device, generally designated by the reference numeral 23, which is arranged laterally to the needle cylinder.

More particularly, a selector 24 is accommodated below each needle 5 in the axial grooves 3; said selector is of a known type, and is preferably constituted by a selector which is oscillable in a plane which is radial with respect to the needle cylinder from an active position, whereat it protrudes from the axial groove 3 with a heel 24*a* so as to engage a selector actuation cam 25, to an inactive position, whereat the selector is sunk, with its heel 24*a*, in the related axial groove 3 so as to not engage the actuation cam 25.

The selector actuation cam 25 has an annular extension around the needle cylinder 2 with an ascending portion 25*a* arranged upstream of the feed 6 and with a descending portion 25*b* arranged downstream of the feed 6 to allow the lowering of the selectors 24, caused by a counter-cam 26 which is arranged in an upward position, also has an annular extension and is shaped substantially complementarily with respect to the cam 25.

The needle selection device 23 can be of a known type, preferably a device of the type which allows needle by needle selection, and is constituted by a plurality of levers 27 located upstream of the ascending portion 25*a* of the cam 25 and arranged at mutually different vertical levels. The levers 27 can be actuated so as to make contact, or not make contact, with lugs 24*b* of the selectors which protrude from the grooves 3 of the needle cylinder when the related selector 24 is in active position. Contact of the levers 27, which can be actuated in a known manner according to a preset knitting program, with the selectors 24 shifts the selectors 24 from the active position to the inactive position, avoiding the engagement of the selectors with the cam 25. If the levers 27 do not make contact with the selectors 24, said selectors remain in the active position, engaging the cam 25.

A cam, not illustrated for the sake of simplicity, is arranged upstream of the levers 27 in a per se known manner and acts on the lower end of the selectors in the inactive position to move them to the active position and undergo the selection performed by the levers 27.

The auxiliary jacks 19 are operatively connected to the underlying selector 24, since their lower end constitutes an abutment which faces an abutment 28 defined by the related lo needle 5 so that the rise of the selector 24 causes the rise of the overlying needle 5 and of the related auxiliary jack 19.

Each auxiliary jack 19 is furthermore provided with a heel 19*a* which protrudes from the related axial groove 3 to engage cams 29 for the actuation of the jacks 19 which laterally face the needle cylinder 2 at the level of said jacks 19.

The actuation cams 29, which define paths for the heels 19*a* of the jacks, comprise a cam 30 which is arranged downstream of the ascending portion 25*a* of the cam 25 and downstream of the feed 6. Said cam 30 has an ascending portion 30*a* to raise the auxiliary jacks 19, which engage it, so as to move them to act with their upper end on the related sinker 14.

The auxiliary jacks 19, as a consequence of the rise of the underlying selector 24, can move from a deactivation position, in which their heel 19*a* does not engage the cam 30, to an activation position, in which their heel 19*a* engages said cam.

Between the ascending portion 25*a* of the cam 25 and the cam 30 it is possible to provide an intermediate cam 31, arranged at the level of the heel 19*a* of the jacks, which separates paths followed by the heels 19*a* of the jacks in activation position and by the heels of the jacks in deactivation position.

In practice, the heels 19*a* of the jacks which have been raised by the selectors 24 which have engaged the cam 25 pass on the intermediate cam 31, which raises them further so as to cause their subsequent engagement with the cam 30, whereas the heels 19*a* of the jacks which have not been raised, since the underlying selector has been moved to the inactive position by the selection device 23, pass below both the cam 31 and the cam 30 and thus are not moved to act on the related overlying casting-off sinker 14.

A reset cam 32 is provided upstream of the ascending portion 25*a* of the cam 25, at the level of the heels 19*a* of the jacks 19, and has a descending portion 32*a* which engages the heels 19*a* of the jacks, which have been moved beforehand into the activation position and have engaged the cam 30, causing their transfer to the deactivation position to be actuated again by the selectors 24 following a new selection performed by the device 23.

Conveniently, the cams 30, 31 and 32 are fixed to a block 33 which can move, when actuated, in a direction which is radial with respect to the needle cylinder 2 from an insertion position, in which the cams 30, 31 and 32 are close to the needle cylinder 2 so as to engage the heels 19*a* of the jacks 19 in activation position, to an extraction position, in which they are laterally spaced from the needle cylinder 2 so as to not interfere with the heels 19*a* of the jacks 19.

When the cams 30, 31 and 32 are spaced from the needle cylinder, the machine can work like a conventional machine and the needle selection device 23 can be used, in a known manner, to perform particular patterns or knitting.

The operation of the machine according to the present invention in the production of knitting with toweling-stitch patterns is as follows.

For the sake of greater clarity, FIG. 4 illustrates the paths followed by the heels 5*a* of the needles 5, of the auxiliary jacks 19 and of the selectors 24. The path followed by the heels 24*a* of the selectors 24 in the inactive position is shown in dotted lines, whereas the path followed by the heels 24*a* of the selectors 24 in the active position is shown in dashed lines.

Similarly, the path followed by the heels 5*a* of the needles 5 and by the heels 19*a* of the auxiliary jacks 19 which lie above the selectors 24 in the inactive position is shown in dotted lines, whereas the path followed by the heels 5*a* of the needles 5 and of the auxiliary jacks 19 which lie above the selectors 24 in the active position is shown in dashed lines.

To produce a pattern with toweling stitches, the levers 27 are actuated so as to push into inactive position the selectors 24 which are in the same axial grooves 3 together with the needles which must not form toweling stitches, and so as to keep in active position the selectors 24 which are in the same axial grooves accommodating the needles which must form toweling stitches.

In this manner, the auxiliary jacks 19 arranged in the axial grooves 3 accommodating the selectors pushed into the inactive position pass with their heel 19*a* below the cams 31 and 30 and do not act on the overlying casting-off sinkers 14 which are actuated by the related cams so that, during the descent of the needle 5, after taking up two threads 21 and 22 delivered by the thread guides 7 at the feed 6, said threads 21 and 22 both rest on the lower casting-off surface 15, producing loops with two threads of equal length.

The auxiliary jacks 19 arranged in the axial grooves 3 which also accommodate the selectors 24 kept in an active position, following the engagement of the selectors with the ascending portion 25*a* of the cam 25, are raised and engage the ascending portions 31*a* and 30*a* of the cams 31 and 30. The rise caused by the cam 30 moves the auxiliary jacks so that they act on the overlying casting-off sinkers 14, which are moved closer still to the axis 4 of the needle cylinder 2, while the needles 5 are moving downward after engaging the two threads 21 and 22 at the feed 6. In this manner, the tab 17 is inserted between the two threads 21 and 22 which rest respectively on the upper casting-off surface 16 and on the lower casting-off surface 15, thus forming toweling stitches.

Since a selection device 23 is provided upstream of each feed of the machine, it is possible to vary the position of the toweling stitches at each row of knitting and thus obtain patterns even with complicated shapes.

In practice it has been observed that the machine according to the invention fully achieves the intended aim, since it allows to produce patterns with toweling stitches having the desired shape.

A further advantage is that it is possible to use known needle selection devices to produce patterns with toweling stitches.

Another advantage is that it is possible to vary the patterns which can be produced with toweling stitches simply by varying the program for actuating the selection device, without performing manual interventions on the machine.

The machine thus conceived is susceptible to numerous modifications and variations, all of which are within the scope of the inventive concept; thus, for example, it is also possible to use selection devices which differ from the one described, as well as selectors of a different type, for example selectors which cannot oscillate.

All the details may furthermore be replaced with technically equivalent elements.

In practice, the materials employed, as well as the dimensions, may be any according to the requirements and the state of the art.

We claim:

1. Circular knitting machine for manufacturing socks r stockings, with a device for producing patterns with toweling stitches, comprising;

a needle cylinder having a needle cylinder axis and skirt on which a plurality of axial grooves is defined, each one of said grooves slideably accommodating a needle slideable along directions which are parallel to the needle cylinder axis, and having a heel protruding radially from the related axial groove and engageable within paths defined by needle actuation cams arranged around the needle cylinder upon a rotation of the needle cylinder about said needle cylinder axis with respect to said needle actuation cams;

a sinker ring arranged proximate to the upper end of the needle cylinder, said sinker ring being rigidly associated with the needle cylinder, a plurality of radial grooves being defined in said sinker ring, said radial grooves being angularly offset with respect to said axial grooves, each radial groove slideably accommodating a casting-off sinker defining two casting-off surfaces which are mutually spaced in a direction which is parallel to the needle cylinder axis;

auxiliary jacks operatively connected to selectors, said auxiliary jacks each having an upper end and being individually accommodated in said axial grooves proximate to said needles, actuating means for moving said auxiliary jacks parallel to said needle cylinder axis whereby said upper end acts on said casting-off sinkers to move them along a direction radial to the needle cylinder from a rearward position, which produces the resting of two threads engaged by the contiguous needles on a same one of said two casting-off surfaces to form loops with two threads of equal length, to an advanced position in the direction of the axis of the needle cylinder, which causes the resting of two threads engaged by the contiguous needles respectively on one of said two casting-off surfaces and on the other one of said two casting-off surfaces to form loops with two threads of mutually different lengths, and;

a reset cam laterally facing the needle cylinder substantially at the level of said auxiliary jacks, said reset cam having a descending portion arranged upstream of the ascending portion of cams for the actuation of said selectors, along the direction of rotation o the needle cylinder with respect to said cams, said reset cam being engageable with the heel of the auxiliary jacks in said activation position to shift them to said deactivation position, wherein said auxiliary jack actuation cam and said reset cam are movable, when actuated, in a radial direction with respect to eh needle cylinder from an insertion position, in which they engage the heels of the auxiliary jacks in said activation position, to an extraction position, in which they are spaced laterally to the needle cylinder so as to not interfere with the heel of said auxiliary jacks.

* * * * *